US009513577B2

(12) United States Patent
Fukamachi et al.

(10) Patent No.: US 9,513,577 B2
(45) Date of Patent: Dec. 6, 2016

(54) DEVELOPING CARTRIDGE

(71) Applicant: Brother Kogyo Kabushiki Kaisha, Nagoya-shi, Aichi-ken (JP)

(72) Inventors: Yasuo Fukamachi, Nagoya (JP); Motoaki Mushika, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/850,703

(22) Filed: Sep. 10, 2015

(65) Prior Publication Data

US 2016/0223948 A1 Aug. 4, 2016

(30) Foreign Application Priority Data

Jan. 30, 2015 (JP) ..... 2015-017344

(51) Int. Cl.
*G03G 15/08* (2006.01)

(52) U.S. Cl.
CPC ..... *G03G 15/0877* (2013.01); *G03G 15/0875* (2013.01)

(58) Field of Classification Search
CPC ..... G03G 15/0831; G03G 15/0881; G03G 15/0896
USPC ..... 399/27, 111, 119
See application file for complete search history.

(56) References Cited

U.S. PATENT DOCUMENTS 8,195,069 B2 * 6/2012 Handa ..... G03G 15/0881 399/109
2010/0104327 A1 4/2010 Handa et al.

FOREIGN PATENT DOCUMENTS

JP 2010-107619 A 5/2010

* cited by examiner

*Primary Examiner* — Hoang Ngo
(74) *Attorney, Agent, or Firm* — Banner & Witcoff, Ltd.

(57) ABSTRACT

A developing cartridge includes a casing configured to hold developing agent therein, a developing roller rotatably supported by the casing, the developing roller configured to rotate about a first axis, an agitator configured to agitate the developing agent in the casing and to rotate about a second axis and a window member disposed around a through hole. The casing includes a first frame including a first wall having the through hole and a second wall spaced apart from the first wall and a second frame that contacts the first wall and the second wall and includes an extension extending along an outer surface of the first wall. The window member is disposed between the second axis and the second frame. The window member is also disposed between the first wall and the extension and supported by the first wall and the extension.

20 Claims, 5 Drawing Sheets

DEVELOPING CARTRIDGE

CROSS-REFERENCE TO RELATED APPLICATION

This application claims priority from Japanese Patent Application No. 2015-017344 filed on Jan. 30, 2015, the content of which is incorporated herein by reference in its entirety.

FIELD OF DISCLOSURE

The disclosure relates to a developing cartridge including a window member.

BACKGROUND

A known developing cartridge includes a window member. The developing cartridge is provided at an outer surface of a casing with a detection window constituted by a window member. The detection window is for detecting a residual amount of developing agent from outside the developing cartridge. For example, the developing cartridge includes a first frame and a second frame. The first frame is a container-like frame with an upper side thereof open and configured to accommodate or contain toner. The second frame is used as a cover or lid for the first frame. A side wall of the first frame has an opening. The window member engages the opening. The developing cartridge includes a rotatable agitator in the casing. An amount of developing agent floated or flying in the developing cartridge when the agitator rotates, may be detected via the window member.

SUMMARY

Developing agent stays longer, for example, at a portion of the developing cartridge closer to a bottom surface thereof than the agitator. In this case, if a window member is disposed at a position closer to the bottom surface of the developing cartridge than the agitator, it is difficult to detect an amount of developing agent floated by the agitator via the window member. Therefore, it is considered that a window member is disposed at a position closer to the second frame than the agitator.

However, various members required to operate the developing cartridge are disposed at a side surface of the first frame. Therefore, space in the side surface of the first frame is limited, and it may be difficult to provide a structure for supporting a window member to the first frame.

One or more aspects of the disclosure are to provide a developing cartridge that may be able to support a window member at a side surface of a first frame even when the window member is disposed at a position closer to a second frame.

According to the disclosure, a window member may be supported by an extension provided at a second frame. Therefore, the window member may be supported at a side surface of a first frame, without providing a portion for supporting the window member between a first wall and the extension, to the first frame.

DETAILED DESCRIPTION

An illustrative embodiment will be described with reference to the accompanying drawings. Hereinafter, description will be made with reference to a top-bottom direction, a front-rear direction, and a left-right direction as depicted in FIGS. 1-5C.

Figure 1:
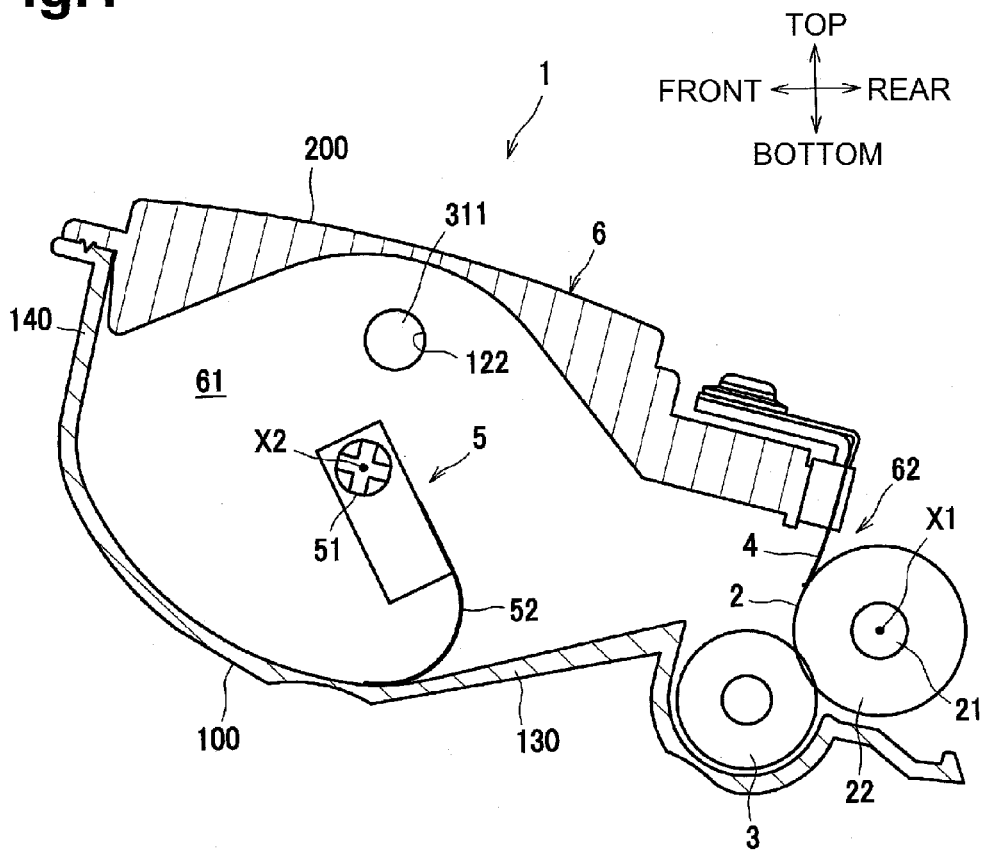
FIG. 1 is a sectional view of a developing cartridge in an illustrative embodiment according to one or more aspects of the disclosure.
Figure 2:
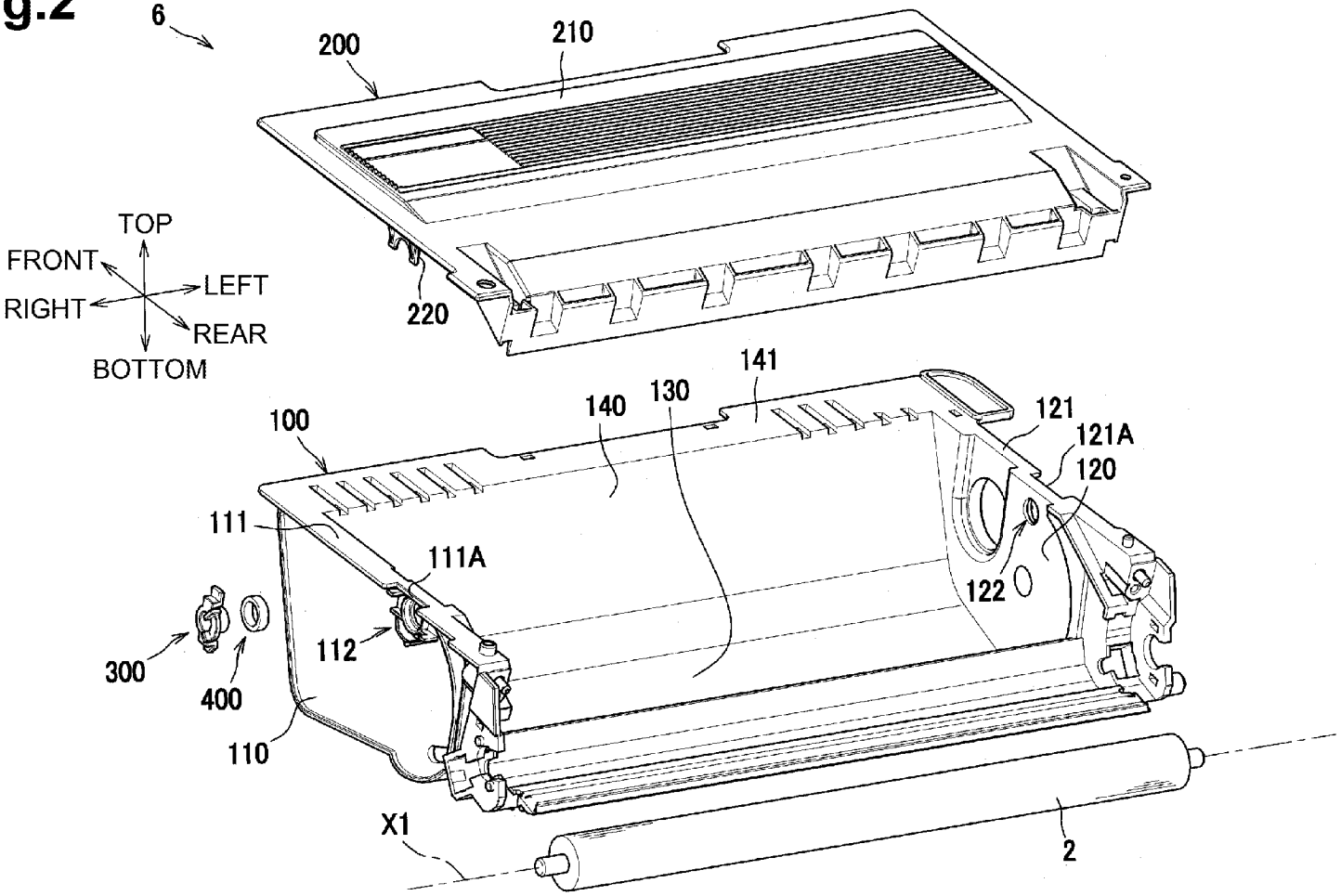
FIG. 2 is an exploded perspective view of a casing, a developing roller, a window member and a sealing member of the developing cartridge.

As depicted in FIGS. 1 and 2, a developing cartridge 1 is configured to be installed in an image forming apparatus, e.g., a laser printer. As depicted in FIG. 1, the developing cartridge 1 includes a developing roller 2, a supply roller 3, a layer thickness regulating blade 4, an agitator 5, and a casing 6. The casing 6 supports the developing roller 2, the supply roller 3, the layer thickness regulating blade 4, and the agitator 5.

The casing 6 includes a toner chamber 61. The toner chamber 61 is configured to store developing agent, e.g., toner, therein. The casing 6 has an opening 62 provided at a rear surface thereof.

The developing roller 2 is configured to carry toner thereon. The developing roller 2 extends in the left-right direction. The developing roller 2 includes a shaft 21 and a roller body 22. The shaft 21 extends in the left-right direction. The roller body 22 is a tubular member that covers a portion of the shaft 21. The roller body 22 is configured to rotate about the shaft 21 together with the shaft 21. The shaft 21 is rotatably supported by the casing 6. The shaft 21 may be directly supported by the casing 6 so as to rotate. Alternatively, the shaft 21 may be indirectly supported by the casing 6 such that the shaft 21 may be rotatably mounted to a bearing that is supported by the casing 6. With such structure, the developing roller 2 is configured to pivot about a first axis X1 (refer to FIGS. 1 and 2) passing through the center of the shaft 21 and extending along a first direction, e.g., the left-right direction. The developing roller 2 is disposed at a position to close the opening 62 of the casing 6 with a surface of the roller body 22.

The supply roller 3 is configured to supply toner to the developing roller 2. The supply roller 3 extends in the left-right direction. The supply roller 3 is disposed in the casing 6 between the developing roller 2 and the toner chamber 61 in the front-rear direction. The layer thickness regulating blade 4 is configured to regulate a thickness of a layer of toner on the developing roller 2. An end of the layer thickness regulating blade 4 is fixed to the casing 6 and the opposite end of the blade 4 is in contact with the developing roller 2.

The agitator 5 is disposed in the toner chamber 61. The agitator 5 includes a shaft portion 51 and an agitator blade 52. The shaft portion 51 extends in the left-right direction and is rotatably supported by the casing 6. The shaft portion 51 may be directly supported by the casing 6 so as to rotate. Alternatively, the shaft portion 51 may be indirectly supported by the casing 6 such that the shaft portion 51 may be rotatably mounted to a bearing that is supported by the casing 6. The agitator blade 52 is configured to rotate about the shaft portion 51 as the shaft portion 51 rotates. The agitator 5 is configured to rotate about a second axis X2 passing through the center of the shaft portion 51 and extending along the left-right direction. The agitator 5 is configured to agitate the toner in the toner chamber 61 as the agitator 5 rotates.

The casing 6 includes a first frame 100 and a second frame 200. The first frame 100 is a container-like frame with an upper side thereof open and configured to contain toner therein. The second frame 200 is used as a cover or a lid for the first frame 100 and placed over the first frame 100. The first frame 100 and the second frame 200 define the toner chamber 61 by making contact with each other.

The casing 6 includes a toner empty window 311. The toner empty window 311 is a transparent member to allow an amount of toner remaining in the toner chamber 61 to be detected from an exterior of the casing 6. The toner empty window 311 is disposed on left and right sides of the casing 6. In FIG. 1, a left toner empty window 311 is depicted. The toner empty window 311 will be described in detail later. For example, an image forming apparatus includes a known optical sensor including a light emitting portion (not depicted) disposed outside one of the toner empty windows 311 and a light receiving portion (not depicted) disposed outside the other one of the toner empty windows 311. The optical sensor is configured to detect light emitted from the light emitting portion via the toner empty windows 311, so that an amount of toner remaining in the toner chamber 61 is detected.

The first frame 100 supports the developing roller 2, the supply roller 3 and the agitator 5. As depicted in FIG. 2, the first frame 100 includes a first wall 110 and a second wall 120. The first wall 110 and the second wall 120 are spaced apart in the left-right direction. The first wall 110 and the second wall 120 face each other in the left-right direction. The first frame 100 further includes a bottom wall 130 and a front wall 140. The bottom wall 130 is disposed between the first wall 110 and the second wall 120. The front wall 140 is disposed between the first wall 110 and the second wall 120. The first frame 100 includes resin.

The first wall 110 supports a right end portion of the developing roller 2. The first wall 110 includes a first flange portion 111 disposed at an upper end thereof. The first flange portion 111 extends in the left-right direction. The second wall 120 supports a left end portion of the developing roller 2. The second wall 120 includes a second flange portion 121 disposed at an upper end thereof. The second flange portion 121 extends in the left-right direction. The first flange portion 111 includes a recess portion 111A. The recess portion 111A is disposed above a through hole 112. The recess portion 111A is recessed from a right side of the first flange portion 111 toward a left side of the first flange portion 111. An extension 220 (described below) is disposed at the recess portion 111A. The second flange portion 121 includes a recess portion 121A. The recess portion 121A is disposed above a through hole 122. The recess portion 121A is recessed from a left side of the second flange portion 121 toward a right side of the second flange portion 121. An extension 220 (described below) is disposed at the recess portion 121A.

The bottom wall 130 is a lowest wall of the toner chamber 61. The bottom wall 130 connects a lower end of the first wall 110 and a lower end of the second wall 120. The front wall 140 defines or covers a front side the toner chamber 61 and connects a front end of the first wall 110 and a front end of the second wall 120. An upper end of the front wall 140 is level with an upper end of the first wall 110 and an upper end of the second wall 120. The front wall 140 includes a third flange portion 141 disposed at an upper end thereof. The third flange portion 141 extends in the front-rear direction.

The second frame 200 includes a main body 210. The main body 210 has a plate shape. The main body 210 contacts the first flange portion 111, the second flange portion 121, and the third flange portion 141. The main body 210 is fixed to the first flange portion 111, the second flange portion 121, and the third flange portion 141, for example, by welding. Thus, the main body 210 is fixed to an upper end of each of the first wall 110, the second wall 120, and the front wall 140.

The first wall 110 has the through hole 112. The second wall 120 has the through hole 122. Each of the through hole 112 and the through hole 122 is a circular opening. The through hole 112 and the through hole 122 are disposed facing each other in the left-right direction. As depicted in FIGS. 1 and 2, the through hole 112 is disposed at an upper end portion of the first wall 110. More specifically, the through hole 112 is disposed above the shaft portion 51 of the agitator 5 between the shaft portion 51 (e.g., the second axis X2) and the second frame 200 in the top-bottom direction. As long as the through hole 112 is disposed between the shaft portion 51 and the second frame 200 in the top-bottom direction, the through hole 112 may be shifted from the shaft portion 51 in the front-rear direction.

The developing cartridge 1 further includes a window member 300 and a sealing member 400. The window member 300 and the sealing member 400 are attached to the through hole 112. FIG. 2 depicts the window member 300 and the sealing member 400 that are to be attached to the first wall 110. A window member 300 and a sealing member 400 are attached to the through hole 122 of the second wall 120 (not depicted in FIG. 2).

As depicted in FIG. 2, the second frame 200 includes an extension 220. The extension 220 is disposed at a right end portion of the main body 210. The extension 220 is disposed at a position corresponding to the through hole 112 in the front-rear direction. The extension 220 protrudes from the main body 210 toward the first frame 100. The extension 220 is a, for example, plate extending from the main body 210 toward the first frame 100. The extension 220 may be a plate-like member. An extension 220 is disposed at a left end portion of the main body 210, though FIG. 2 does not depict the left extension 220. The extension 220 is disposed at a position corresponding to the through hole 122 in the front-rear direction. In the illustrative embodiment, the right through hole 112, the right window member 300, the right sealing member 400, and the right extension 220 have similar or the same structures as the left through hole 122, the left window member 300, the left sealing member 400, and the left extension 220, respectively. Therefore, the right through hole 112, the right window member 300, the right sealing member 400, and the right extension 220 will be described in detail.

Figure 3:
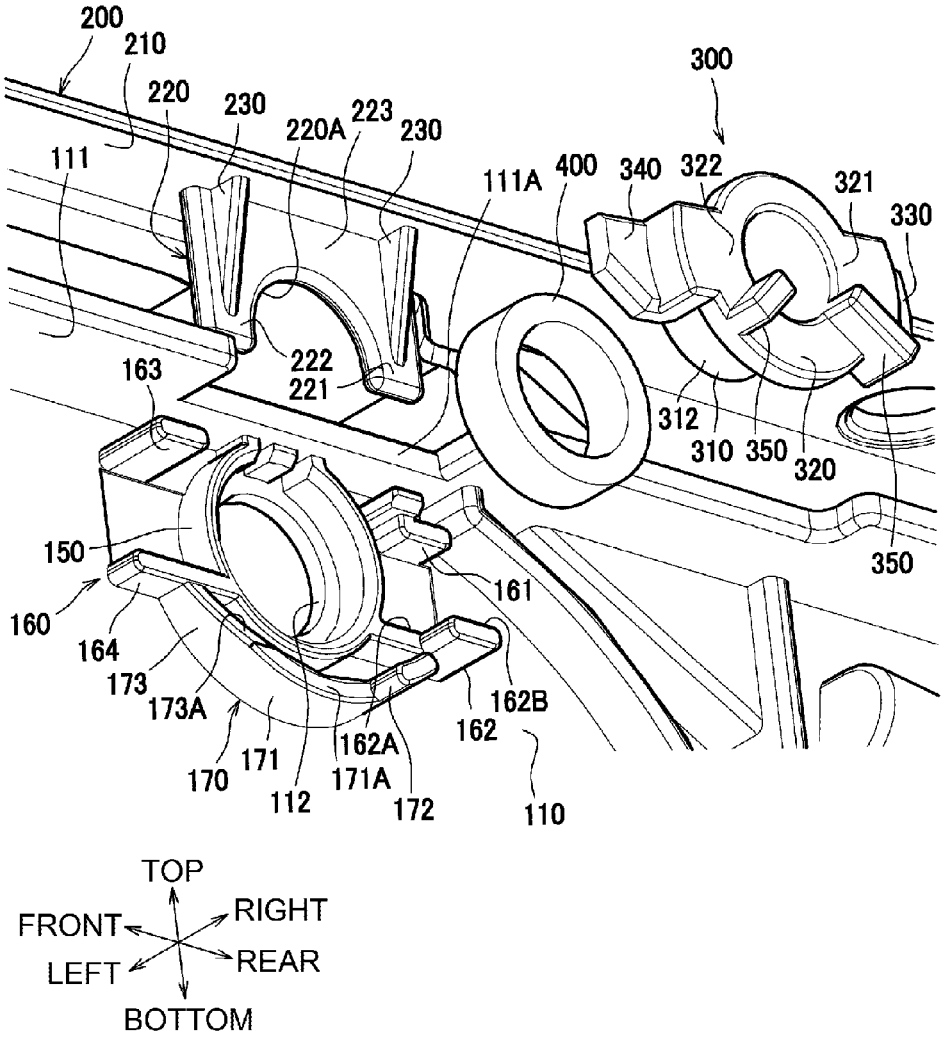
FIG. 3 is an enlarged exploded perspective view of a portion of the developing cartridge, illustrating a through hole and its adjacent structures.

As depicted in FIG. 3, the first wall 110 includes a cylindrical portion 150, a regulator 160, and a second rib 170 that are disposed at peripheral portions of the through hole 112.

The cylindrical portion 150 protrudes from an outer side surface of the first wall 110 in the left-right direction, to partially enclose the through hole 112. An inner diameter of the cylindrical portion 150 is greater than the diameter of the through hole 112. In the illustrative embodiment, a portion of the through hole 112 is not surrounded by the cylindrical portion 150, as depicted in FIG. 3. In another embodiment, the cylindrical portion 150 may be provided continuously to completely surround the through hole 112.

The regulator 160 includes a first regulator portion 161, a second regulator portion 162, a third regulator portion 163, and a fourth regulator portion 164. The first regulator portion 161 and the second regulator portion 162 are disposed to or on a rear side of through hole 112. The third regulator portion 163 and the fourth regulator portion 164 are disposed to or on a front side of the through hole 112. Each of the first regulator portion 161, the second regulator portion 162, the third regulator portion 163, and the fourth regulator portion 164 protrudes from an outer side surface of the first wall 110.

The first regulator portion 161 and the second regulator portion 162 are arranged in line along the top-bottom direction. More specifically, the second regulator portion 162 is disposed below the first regulator portion 161. The first regulator portion 161 is disposed outside the cylindrical portion 150, e.g., behind the cylindrical portion 150, and spaced apart from the cylindrical portion 150. The first regulator portion 161 includes a surface extending in the front-rear direction. The second regulator portion 162 includes a first surface 162A and a second surface 162B. The first surface 162A extends rearward from an outer peripheral surface of the cylindrical portion 150 and faces upward. The second surface 162B extends in the front-rear direction from a rear end portion of the first surface 162A and faces upward. The second surface 162B protrudes from an outer side surface of the first wall 110 further to the left-right direction than the first surface 162A. When viewed from the top-bottom direction, the second regulator portion 162 has a substantially "L" shape. The second surface 162B opposes the first regulator portion 161 in the top-bottom direction, and is spaced apart from the cylindrical portion 150.

The third regulator portion 163 and the fourth regulator portion 164 are arranged in line along the top-bottom direction. More specifically, the fourth regulator portion 164 is disposed below the third regulator portion 163. The third regulator portion 163 is disposed outside the cylindrical portion 150, e.g., in front of the cylindrical portion 150, and spaced apart from the cylindrical portion 150. The third regulator portion 163 includes a surface extending in the front-rear direction. The fourth regulator portion 164 extends frontward from an outer peripheral surface of the cylindrical portion 150, and a front end portion of the fourth regulator portion 164 opposes the third regulator portion 163 in the top-bottom direction.

The second rib 170 is disposed below the through hole 112 and outside the cylindrical portion 150. The second rib 170 extends in the left-right direction from an outer side surface of the first wall 110. The second rib 170 has an arcuate shape extending along a portion of an outer peripheral surface of the cylindrical portion 150. The second rib 170 extends forward from a portion below the second regulator portion 162 along a peripheral edge of the cylindrical portion 150, and connects to the fourth regulator portion 164.

The second rib 170 includes a first rib portion 171, a second rib portion 172, and a third rib portion 173. The second rib portion 172 protrudes from an outer side surface of the first wall 110 further to the left-right direction further than the first rib portion 171 and the third rib portion 173. The first rib portion 171 extends from a front end portion of the second rib portion 172 along a portion of an outer peripheral surface of the cylindrical portion 150. A protruding amount of the first rib portion 171 in the left-right direction from an outer side surface of the first wall 110 is constant. The protruding amount of the first rib portion 171 in the left-right direction from the outer side surface of the first wall 110 does not have to be constant as long as the protruding amount of the first rib portion 171 is smaller than a protruding amount of the second rib portion 172 in the left-right direction from the outer side surface of the first wall 110. An end surface 171A is disposed at an end portion of the first rib portion 171 in the left-right direction. The third rib portion 173 is provided such that a protruding amount thereof in the left-right direction becomes smaller as the third rib portion 173 extends toward the fourth regulator portion 164 from a front end portion of the first rib portion 171. An inclined surface 173A is provided at an end portion of the third rib portion 173 in the left-right direction. A protruding amount of the third rib portion 173 at its front end portion is substantially the same as a protruding amount of the fourth regulator portion 164.

The window member 300 includes transparent resin. The window member 300 includes a window body 310, a window frame 320, protruding portions, e.g., a first protruding portion 330 and a second protruding portion 340, and a holding portion 350 that are integrally formed.

Figure 4A:
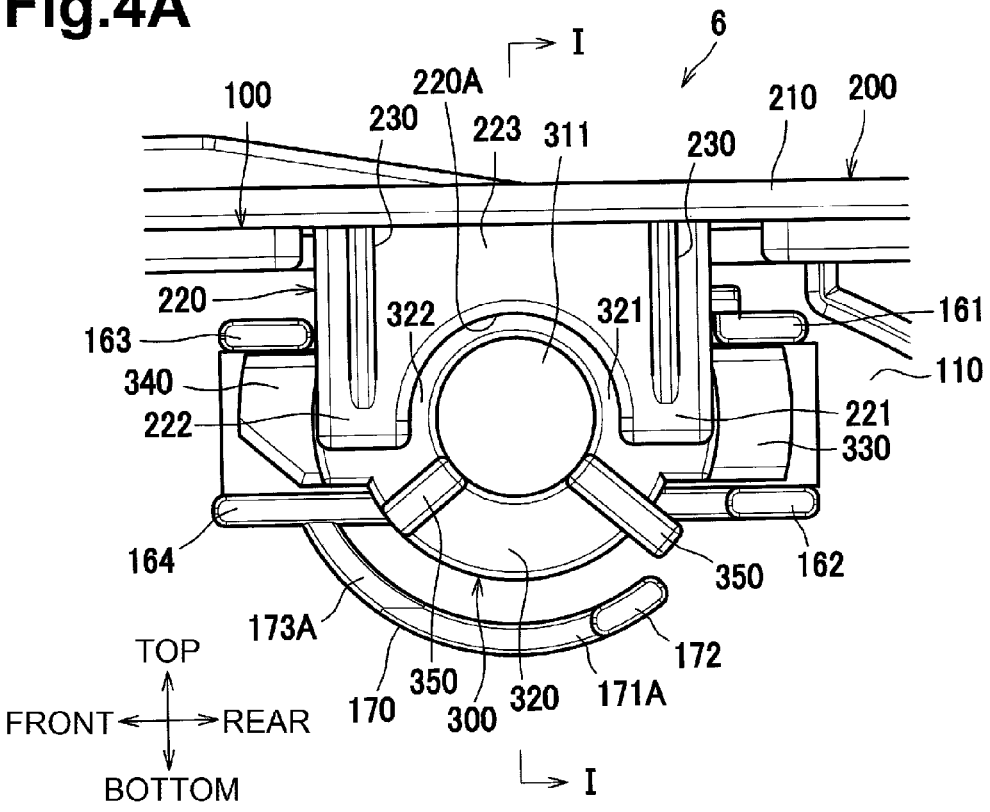
FIG. 4A is a sectional side view of the window member attached to the casing.
Figure 4B:
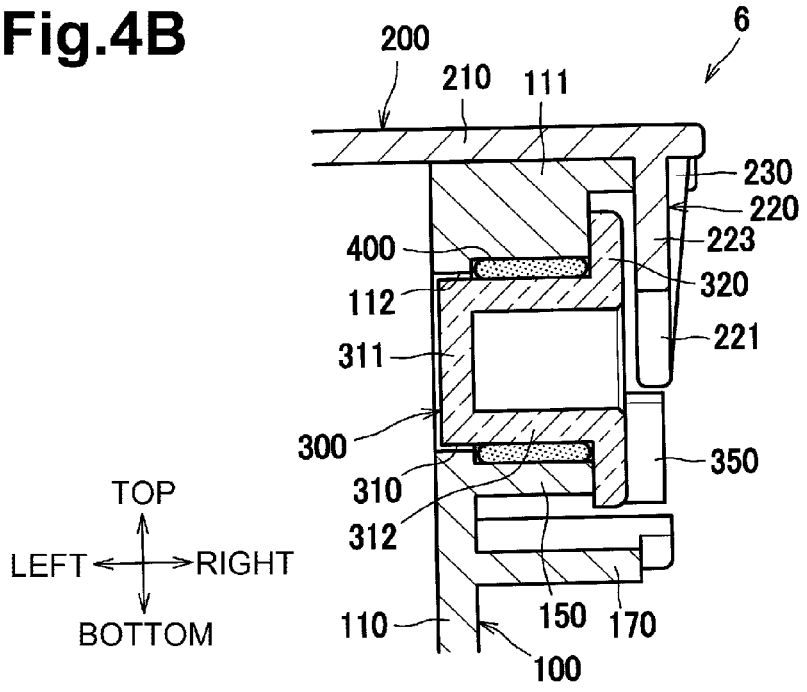
FIG. 4B is a sectional view of the window member attached to the casing, taken along a line I-I of FIG. 4A.

The window body 310 has a bottomed cylindrical shape. The window body 310 includes a toner empty window 311 and a tubular portion 312, as depicted in FIGS. 4A and 4B. The toner empty window 311 has a circular shape. The tubular portion 312 extends from a circumferential edge of the toner empty window 311 in the left-right direction. An outer diameter of the window body 310 is substantially the same as the diameter of the through hole 112.

The window frame 320 is disposed on an opposite side of the toner empty window 311 in the left-right direction. The window frame 320 extends outward in a radial direction of the tubular portion 312 from a right end portion of the tubular portion 312, along an outer side surface of the first wall 110. As depicted in FIG. 3, the window frame 320 is disposed at the entire perimeter of the tubular portion 312.

The window frame 320 includes a first window frame 321 and a second window frame 322. The first window frame 321 extends from the window body 310 along the first wall 110 in a second direction, e.g., in a rearward direction. The second window frame 322 extends from the window body 310 along the first wall 110 in a third direction, e.g., in a frontward direction opposite to the second direction.

The first protruding portion 330 extends outward in a radial direction of the window body 310 from the first window frame 321. More specifically, the first protruding portion 330 extends from the first window frame 321 toward the first wall 110 and further extends rearward. With such structure, an end portion of the first protruding portion 330 is disposed closer to the first wall 110 than the window frame 320.

The second protruding portion 340 is disposed opposite to the first protruding portion 330 relative to the window body 310 in the left-right direction. The second protruding portion 340 extends outward in the radial direction of the window body 310 from the second window frame 322. More specifically, the second protruding portion 340 extends toward the first wall 110 from the second window frame 322 and further extends forward. With such structure, an end portion of the second protruding portion 340 is disposed closer to the first wall 110 than the window frame 320.

The holding portion 350 is disposed on the window frame 320. The holding portion 350 is a protrusion protruding from the window frame 320 in the left-right direction. Two holding portions 350 are disposed with a space therebetween in a circumferential direction of the window frame 320.

As depicted in FIGS. 3 and 4B, an inner diameter of the sealing member 400 is slightly smaller than an outer diameter of the window body 310. An outer diameter of the sealing member 400 is slightly greater than an inner diameter of the cylindrical portion 150. The sealing member 400 is disposed between the window body 310 and the cylindrical portion 150, as depicted in FIG. 4B. With the sealing member 400, toner leakage from a gap or space between the window body 310 and the cylindrical portion 150 may be prevented or reduced. The sealing member 400 includes an elastic material. The sealing member 400 has, for example, a ring shape, as depicted in FIG. 3.

In the window member 300, the window body 310 is inserted into the cylindrical portion 150 and the toner empty window 311 is disposed inside the through hole 112, as depicted in FIGS. 4A and 4B. The window frame 320 contacts a right end of the cylindrical portion 150.

The extension 220 is disposed opposite to the first wall 110 in the left-right direction, relative to the window member 300. The window member 300 is disposed between the outer side surface of the first wall 110 and the extension 220. Accordingly, the window member 300 is supported by the outer side surface of the first wall 110 and the extension 220. The extension 220 extends from the main body 210 toward the through hole 112 along the outer side surface of the first wall 110. More specifically, the extension 220 includes a recess portion 220A that is concavely recessed upward from a lower end of the extension 220. The recess portion 220A is arcuately recessed. With the second frame 200 placed on the first frame 100, an arc of the recess portion 220A extends along the perimeter of the cylindrical portion 150. The extension 220 includes a first extension 221, a second extension 222, and a connecting portion 223. The first extension 221 extends downward from the main body 210, and is disposed on a right side of the cylindrical portion 150. The second extension 222 extends downward from the main body 210, and is disposed on a left side of the cylindrical portion 150. The connecting portion 223 connects upper end portions of the first extension 221 and the second extension 222. The recess portion 220A that is arcuately recessed is defined by the first extension 221, the second extension 222, and the connecting portion 223. A left side surface of the window member 300 depicted in FIG. 4B may be disposed further to the left than the first wall 110. In other words, the left side surface of the window member 300 depicted in FIG. 4B may protrude in the left-right direction relative to the first wall 110. Alternatively, the left side surface of the window member 300 depicted in FIG. 4B may be at the same position as the first wall 110 in the left-right direction or flush with the first wall 110.

A first rib 230 is provided at each of the first extension 221 and the second extension 222. Each first rib 230 extends in the left-right direction and the top-bottom direction from a corresponding first extension 221 and the second extension 222. An upper end of each first ribs 230 is connected to the main body 210. Each first rib 230 extends to a lower end portion of a corresponding first extension 221 and the second extension 222. As the first rib 230 is provided to each of the first extension 221 and the second extension 222, the first extension 221 and the second extension 222 are reinforced. Accordingly, damages on the first extension 221 and the second extension 222 may be prevented or reduced.

As depicted in FIG. 4A, the first extension 221 overlaps with a portion of the first window frame 321 when viewed from the left-right direction. In other words, a portion of the first window frame 321 is disposed between the outer side surface of the first wall 110 and the first extension 221, and is supported by the outer side surface of the first wall 110 and the first extension 221.

The second extension 222 overlaps with a portion of the second window frame 322 when viewed from the left-right direction. In other words, a portion of the second window frame 322 is disposed between the outer side surface of the first wall 110 and the second extension 222, and supported by the outer side surface of the first wall 110 and the second extension 222.

As the window frame 320 is disposed between the outer side surface of the first wall 110 and the extension 220, the window member 300 may be prevented from coming off from the cylindrical portion 150, and the window member 300 can be fixed to the first frame 100. In the illustrative embodiment, for smooth attachment of the second frame 200, a space is provided between the extension 220 and the window member 300.

An end portion of the first protruding portion 330 is disposed between the first regulator portion 161 and the second regulator portion 162 in the top-bottom direction. A tip end portion of the second protruding portion 340 in the top-bottom direction is disposed between the third regulator portion 163 and the fourth regulator portion 164.

Thus, the first protruding portion 330 is disposed between the first regulator portion 161 and the second regulator portion 162, and the second protruding portion 340 is disposed between the third regulator portion 163 and the fourth regulator portion 164. Accordingly, the movement of the window member 300 in the top-bottom direction is regulated. More specifically, for example, as the window body 310 tries to rotate clockwise in FIG. 4A along or relative to the through hole 112, the first protruding portion 330 contacts the second regulator portion 162 and the second protruding portion 340 contacts the third regulator portion 163, so that the rotation of the window member 300 may be regulated. As the window body 310 tries to rotate counterclockwise in FIG. 4A along or relative to the through hole 112, the first protruding portion 330 contacts the first regulator portion 161, and the second protruding portion 340 contacts the fourth regulator portion 164, so that the rotation of the window member 300 may be regulated.

Next, attachment of the window member 300 will be described.

Figure 5A:
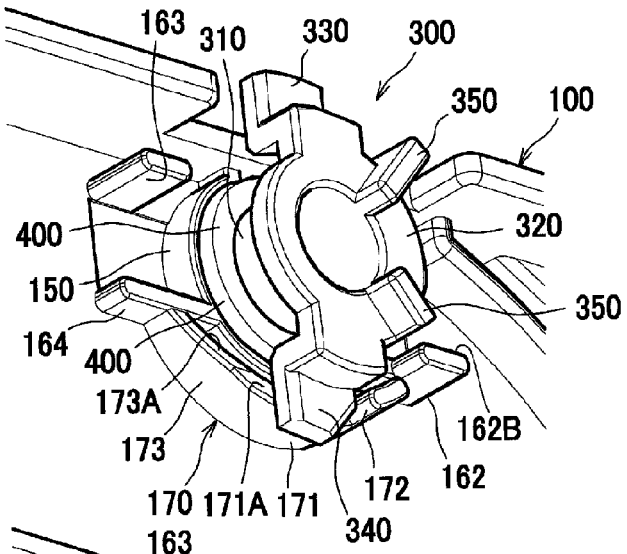
FIGS. 5A-5C are diagrams illustrating processes of attaching the window member.

To attach the window member 300 to the casing 6, the sealing member 400 is first placed into the cylindrical portion 150, as depicted in FIG. 5A. An operator puts the window body 310 of the window member 300 to the sealing member 400, while holding the holding portions 350, such that the first protruding portion 330 faces upward and the second protruding portion 340 faces downward. At this time, the second protruding portion 340 is placed on the end surface 171A of the second rib 170, and the first protruding portion 330 is placed in the recess portion 111A of the first flange portion 111.

Figure 5B:
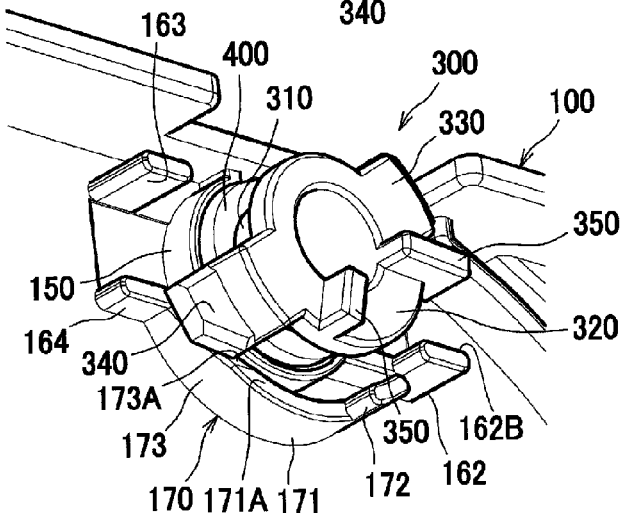

As depicted in FIG. 5B, the operator rotates the window member 300 clockwise in FIG. 5B. At this time, the second rib portion 172 is disposed behind the second protruding portion 340. Therefore, as the operator rotates the window member 300 counterclockwise in FIG. 5B, the window member 300 contacts the second rib portion 172. Accordingly, the operator may be prevented from rotating the window member 300 counterclockwise in FIG. 5B and encouraged to rotate the window member 300 clockwise in FIG. 5B. With the second rib portion 172, the operator may be prevented from mistaking a rotating direction of the window member 300.

As the window member 300 is rotated clockwise in FIG. 5B, a surface that contacts the second protruding portion 340 changes from the end surface 171A to the inclined surface 173A. Accordingly, the window member 300 gradually moves from the right side to the left side along the inclined surface 173A, so that the window body 310 enters into the cylindrical portion 150 through an interior of the sealing member 400. In other words, the inclined surface 173A guides the attachment of the window member 300.

Thus, the end surface 171A and the inclined surface 173A guide the rotation of the window member 300, so that the window body 310 may be readily inserted into the sealing member 400.

When the operator is rotating the window member 300 clockwise in FIG. 5B, the holding portions 350 do not interfere with the second regulator portion 162 because the second surface 162B of the second regulator portion 162 is spaced from the holding portions 350 by predetermined distances.

Figure 5C:
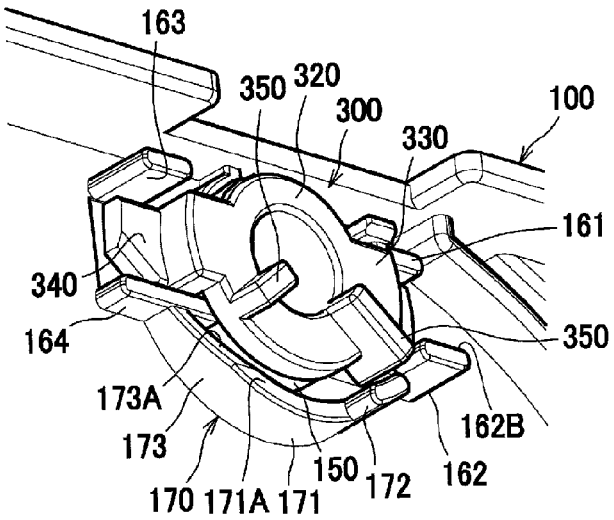

As the second protruding portion 340 passes through the fourth regulator portion 164 as depicted in FIG. 5C, the second protruding portion 340 enters between the third regulator portion 163 and the fourth regulator portion 164. The first protruding portion 330 enters between the first regulator portion 161 and the second regulator portion 162. The window body 310 of the window member 300 entirely enters into the cylindrical portion 150.

Then, the operator puts the second frame 200 on the first frame 100 and fixes the first frame 100 and the second frame 200 with each other.

Effects of the developing cartridge 1 as structured above will be described.

As a portion of the window member 300 is disposed between the outer side surface of the first wall 110 and the extension 220, the window member 300 is supported by the outer side surface of the first wall 110 and the extension 220. Therefore, even when it is difficult to provide a structure for supporting the window member 300 to the first frame 100, the window member 300 may be supported by the extension 220 of the second frame 200.

Especially when the through hole 112 is provided between the shaft portion 51 of the agitator 5 and the second frame 200, as in the illustrative embodiment, it may be difficult to provide a structure for supporting the window member 300 between the shaft portion 51 and the second frame 200. Accordingly, structures of the illustrative embodiment may be effective.

The extension 220 includes the recess portion 220A recessed upward from the lower end of the extension 220. The recess portion 220A is arcuately concaved. With the second frame 200 put on the first frame 100, an arc of the recess portion 220A extends along the perimeter of the cylindrical portion 150. Therefore, such a situation may be prevented that the extension 220 extending over the toner empty window 311 blocks the light passing through the toner empty window 311.

The extension 220 includes the first extension 221 and the second extension 222. The first window frame 321 is disposed between the first extension 221 and the outer side surface of the first wall 110, and the second window frame 322 is disposed between the second extension 222 and the outer side surface of the first wall 110. Therefore, as compared with a structure in which the window frame 320 is held between the outer side surface of the first wall 110 and either one of the first extension 221 and the second extension 222, the window member 300 may be difficult to incline and may be firmly fixed to the first frame 100.

While the disclosure has been described in detail referring to the specific embodiment thereof, this is merely an example, and various changes, arrangements and modifications may be applied therein without departing from the spirit and scope of the disclosure.

In the illustrative embodiment, the window frame 320 of the window member 300 is disposed at the entire perimeter of the window body 310. However, a structure of a window frame is not limited thereto. For example, a window frame may include a first window frame extending frontward from the window body 310 and a second window frame extending rearward from the window body 310. The window frame may be partially provided in a circumferential direction of the window body 310.

In the illustrative embodiment, the regulator 160 includes the first regulator portion 161 and the second regulator portion 162 that interpose the first protruding portion 330 therebetween. The regulator 160 further includes the third regulator portion 163 and the fourth regulator portion 164 that interpose the second protruding portion 340 therebetween. However, the structure of a regulator is not limited thereto as long as a regulator may be configured to regulate rotation of the window member 300. For example, a regulator may include the first regulator portion 161 and the third regulator portion 163. Alternatively, a regulator may include the second regulator portion 162 and the fourth regulator portion 164. A regulator may include the first regulator portion 161 and the second regulator portion 162, or include the third regulator portion 163 and the fourth regulator portion 164.

What is claimed is:

1. A developing cartridge, comprising:

a casing configured to hold developing agent therein, the casing including:

a first frame including a first wall having a first through hole, and a second wall spaced apart from the first wall in a first direction and having a second through hole associated with the first through hole; and a second frame that contacts the first wall and the second wall and includes an extension extending along an outer surface of the first wall, the extension disposed on an outer side of the first wall opposite to, in the first direction, an inner side of the first wall which faces the second wall;

a developing roller rotatably supported by the casing, the developing roller configured to rotate about a first axis extending in the first direction;

an agitator supported by the first frame and configured to agitate the developing agent in the casing and to rotate about a second axis extending in the first direction; and a window member disposed on the first wall and around the first through hole, wherein the window member is disposed between the second axis and the second frame, and wherein the window member is disposed between the first wall and the extension, and supported by the first wall and the extension.

2. The developing cartridge according to claim 1, wherein the window member is sandwiched between the extension and the first wall.

3. The developing cartridge according to claim 1, wherein the window member is held by the extension and the first wall.

4. The developing cartridge according to claim 1,
wherein the window member includes
a window body, and
a window frame extending from a portion of a perimeter of the window body along the first wall, and
wherein a portion of the window frame is disposed between the first wall and the extension, and supported by the first wall and the extension.

5. The developing cartridge according to claim 4, wherein the window frame includes a first window frame extending from the portion of the perimeter of the window body along the first wall in a second direction, and a second window frame extending from the portion of the perimeter of the window body along the first wall in a third direction opposite to the second direction,
the extension includes a first extension extending along the outer surface of the first wall and a second extension extending along the outer surface of the first wall,
at least a portion of the first window frame is disposed between the first wall and the first extension, and supported by the first wall and the first extension, and
at least a portion of the second window frame is disposed between the first wall and the second extension, and supported by the first wall and the second extension.

6. The developing cartridge according to claim 5, wherein a rib is provided at the first extension on a side of the first extension opposite to the first wall and a rib is provided at the second extension on a side of the second extension opposite to the first wall.

7. The developing cartridge according to claim 4,
wherein the window member includes a protruding portion extending outward from the window frame, and
wherein the first wall includes a regulator configured to regulate movement of the window member by contacting the protruding portion.

8. The developing cartridge according to claim 1,
wherein the first wall includes a rib extending outward from the outer surface of the first wall along a periphery of the window member,
wherein the rib includes an inclined surface that is inclined along the periphery of the window member, and
wherein the inclined surface is configured to guide attachment of the window member.

9. A developing cartridge, comprising:
a casing configured to hold developing agent therein, the casing including:
a first frame including
a first wall having a through hole, and
a second wall spaced apart from the first wall in a first direction and having a second through hole associated with the first through hole; and
a second frame that contacts the first wall and the second wall and includes an extension extending along an outer surface of the first wall, the extension disposed on an outer side of the first wall opposite to, in the first direction, an inner side of the first wall which faces the second wall;
a developing roller rotatably supported by the casing;
an agitator supported by the first frame and configured to agitate the developing agent in the casing and to rotate about an axis extending in the first direction; and
a window member disposed on the first wall and around the first through hole,
wherein the window member is sandwiched between the first wall and the extension.

10. The developing cartridge according to claim 9,
wherein the window member includes
a window body, and
a window frame extending from a portion of a perimeter of the window body along the first wall, and
wherein a portion of the window frame is disposed between the first wall and the extension, and supported by the first wall and the extension.

11. The developing cartridge according to claim 10, wherein the window frame includes a first window frame extending from the portion of the perimeter of the window body along the first wall in a second direction, and a second window frame extending from the portion of the perimeter of the window body along the first wall in a third direction opposite to the second direction,
the extension includes a first extension extending along the outer surface of the first wall and a second extension extending along the outer surface of the first wall,
at least a portion of the first window frame is disposed between the first wall and the first extension, and supported by the first wall and the first extension, and
at least a portion of the second window frame is disposed between the first wall and the second extension, and supported by the first wall and the second extension.

12. The developing cartridge according to claim 11, wherein a rib is provided at the first extension on a side of the first extension opposite to the first wall and a rib is provided at the second extension on a side of the second extension opposite to the first wall.

13. The developing cartridge according to claim 11,
wherein the window member includes a protruding portion extending outward from the window frame, and
wherein the first wall includes a regulator configured to regulate movement of the window member by contacting the protruding portion.

14. The developing cartridge according to claim 9,
wherein the first wall includes a rib extending outward from the outer surface of the first wall along a periphery of the window member,
wherein the rib includes an inclined surface that is inclined along the periphery of the window member, and
wherein the inclined surface is configured to guide attachment of the window member.

15. A developing cartridge, comprising:
a casing configured to hold developing agent therein, the casing including:
a first frame including
a first wall having a through hole, and
a second wall spaced apart from the first wall in a first direction and having a second through hole associated with the first through hole; and
a second frame that contacts the first wall and the second wall and includes an extension extending along an outer surface of the first wall, the extension disposed on an outer side of the first wall opposite to, in the first direction, an inner side of the first wall which faces the second wall;
a developing roller rotatably supported by the casing, the developing roller configured to rotate about a first axis extending in the first direction;
an agitator supported by the first frame and configured to agitate the developing agent in the casing and to rotate about a second axis extending in the first direction; and
a window member disposed on the first wall and around the first through hole, wherein the window member is disposed between the first wall and the extension and is closer to the second frame than the first axis.

16. The developing cartridge according to claim 15, wherein the window member is sandwiched between the extension and the first wall.

17. The developing cartridge according to claim 15, wherein the window member includes a window body, and a window frame extending from a portion of a perimeter of the window body along the first wall, and wherein a portion of the window frame is disposed between the first wall and the extension, and supported by the first wall and the extension.

18. The developing cartridge according to claim 17, wherein the window frame includes a first window frame extending from the portion of the perimeter of the window body along the first wall in a second direction, and a second window frame extending from the portion of the perimeter of the window body along the first wall in a third direction opposite to the second direction, the extension includes a first extension extending along the outer surface of the first wall and a second extension extending along the outer surface of the first wall, at least a portion of the first window frame is disposed between the first wall and the first extension, and supported by the first wall and the first extension, and at least a portion of the second window frame is disposed between the first wall and the second extension, and supported by the first wall and the second extension.

19. The developing cartridge according to claim 17, wherein the window member includes a protruding portion extending outward from the window frame, and wherein the first wall includes a regulator configured to regulate movement of the window member by contacting the protruding portion.

20. The developing cartridge according to claim 15, wherein the first wall includes a rib extending outward from the outer surface of the first wall along a periphery of the window member, wherein the rib includes an inclined surface that is inclined along the periphery of the window member, and wherein the inclined surface is configured to guide attachment of the window member.

* * * * *